US007097118B1

(12) United States Patent
Huang

(10) Patent No.: US 7,097,118 B1
(45) Date of Patent: Aug. 29, 2006

(54) SPRAY PAINT GUN WITH SHUNT CONTROL

(75) Inventor: Tiao-Hsiang Huang, Shin Chuang (TW)

(73) Assignee: Kuan Chang Co., Ltd., Taipei (TW)

( * ) Notice: Subject to any disclaimer, the term of this patent is extended or adjusted under 35 U.S.C. 154(b) by 0 days.

(21) Appl. No.: 11/226,251

(22) Filed: Sep. 15, 2005

(51) Int. Cl.
*B05B 1/28* (2006.01)
*B05B 1/00* (2006.01)

(52) U.S. Cl. ..... 239/290; 239/293; 239/349; 239/372; 239/434; 239/569; 239/581.1; 239/600

(58) Field of Classification Search ..... 239/290, 239/291, 293, 346, 345, 340, 337, 349, 372, 239/434, 297, 581.1, 569, 600
See application file for complete search history.

(56) References Cited

U.S. PATENT DOCUMENTS 5,251,821 A * 10/1993 Toth ..... 239/297
5,259,558 A * 11/1993 Smith et al. ..... 239/600
5,695,125 A * 12/1997 Kumar ..... 239/364
6,092,740 A * 7/2000 Liu ..... 239/346
6,533,187 B1 * 3/2003 May ..... 239/1

* cited by examiner

*Primary Examiner*—Dinh Q. Nguyen
(74) *Attorney, Agent, or Firm*—Rosenberg, Klein & Lee

(57) ABSTRACT

A spray paint gun with shunt control includes a housing containing a pressurized air passage, a fluid control valve and an atomization control valve. The pressurized air passage respectively connects through a fluid control air passage and an atomization air passage. Both the fluid control valve and the atomization control valve include a locking nut and a knob, respectively. The locking nut is hollow and provided with external and internal threads to be fastened with its external thread to the housing and connecting through the fluid and atomization air passages, respectively. The fluid control valve and the atomization control valve are respectively fastened to the internal threads of the locking nuts. Both knobs are respectively locked to the fluid control valve and the atomization control valve.

3 Claims, 3 Drawing Sheets

SPRAY PAINT GUN WITH SHUNT CONTROL

BACKGROUND OF THE INVENTION (a) Field of the Invention

The present invention relates to a spray paint gun with shut control, and more particularly, to one allows its user to respectively control paint delivery and atomization in the lateral direction of the spray paint gun.

(b) Description of the Prior Art

The adjustment structure of a conventional spray paint gun is usually divided into fluid and atomization controls. The fluid control is disposed at the rear end of the spray paint and is done by rotating an adjustment screw to control the flow of the pressurized air, and thus the amount of paint to be delivered.

The atomization control is provided at the air cap of the nozzle. By rotating the air cap, the airflow of the atomized air passage located by the main air passage, i.e., the air passage to control the amount of paint, thus to change the extent of the atomization of the paint to be sprayed (i.e., the size of the atomized particles) and the spray pattern.

However, it takes both hands to adjust either control and it prevents the adjustment of both controls at the same time. Therefore, it become very inconvenient to use the spray paint gun since it usually needs several rounds of adjustment back and forth.

SUMMARY OF THE INVENTION

The primary purpose of the present invention is to provide a spray paint gun with shunt control that permits the user to respectively adjust the fluid and atomization in a lateral direction while holding the gun for easier control of the operation.

To achieve the purpose, the present invention comprises a housing, a fluid control valve and an atomization control valve. Wherein, a pressurized air passage is built in the housing. Furthermore, a fluid control air passage and an atomization control air passage are separately provided in the house. The pressurized air passage respectively connects with the fluid control air passage and the atomization control passage. Both the fluid control air passage and the atomization air passage respectively connect through threaded holes laterally provided.

The fluid control valve includes a locking nut and a knob. The locking nut is hollow and provided with external and internal threads while being fastened to the threaded connecting through the fluid control air passage by means of its external thread; the fluid control valve is relatively threaded to engage with the internal thread of the locking nut; and the knob is locked to the fluid control valve. Similarly, the atomization control valve includes a locking nut and a knob; the locking nut is hollow and provided with external and internal threads to be engaged to the threaded hole connecting through the atomization control air passage; the atomization control valve is relatively threaded to engage with the internal thread of the locking nut; and the knob is locked to the atomization control valve.

Wherein, a threaded hole is provided at the end of the fluid control valve, and the knob is relatively fastened to the threaded hole by means of a bolt. Similarly, a threaded hole is provided at the end of the atomization control valve, and the knob is relatively fastened to the threaded hole by means of a bolt.

Accordingly, the present invention provides the following advantages:

1. Convenient operation since the user is allowed to respectively adjust the fluid and the atomization in the lateral direction of the housing of the spray paint gun; and 2. Easier adjustment since it takes only to turn the nut in the lateral direction of the housing of the spray paint gun.

DETAILED DESCRIPTION OF THE PREFERRED EMBODIMENTS

Figure 1:
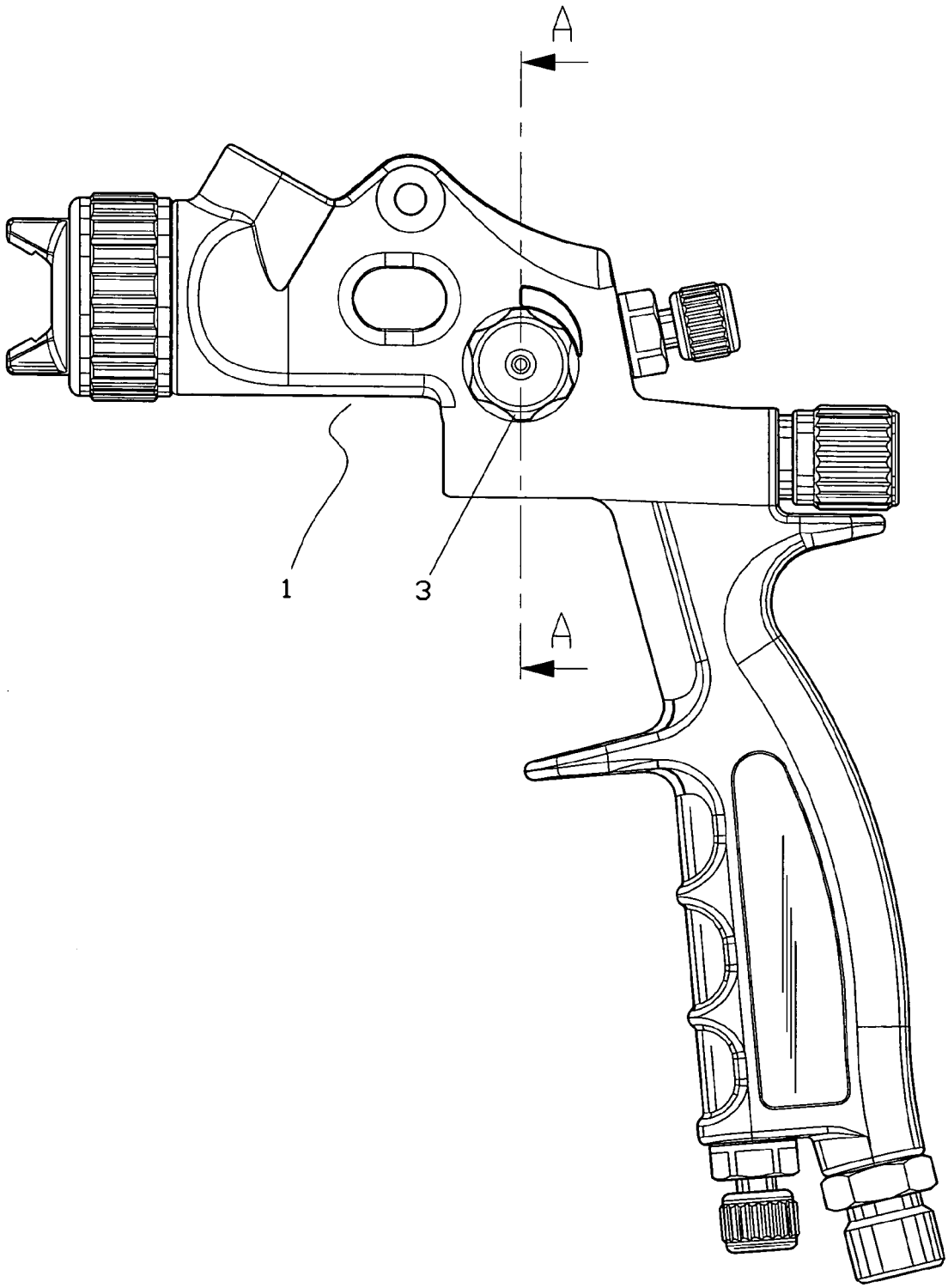
FIG. 1 is a side view of a preferred embodiment of the present invention.
Figure 2:
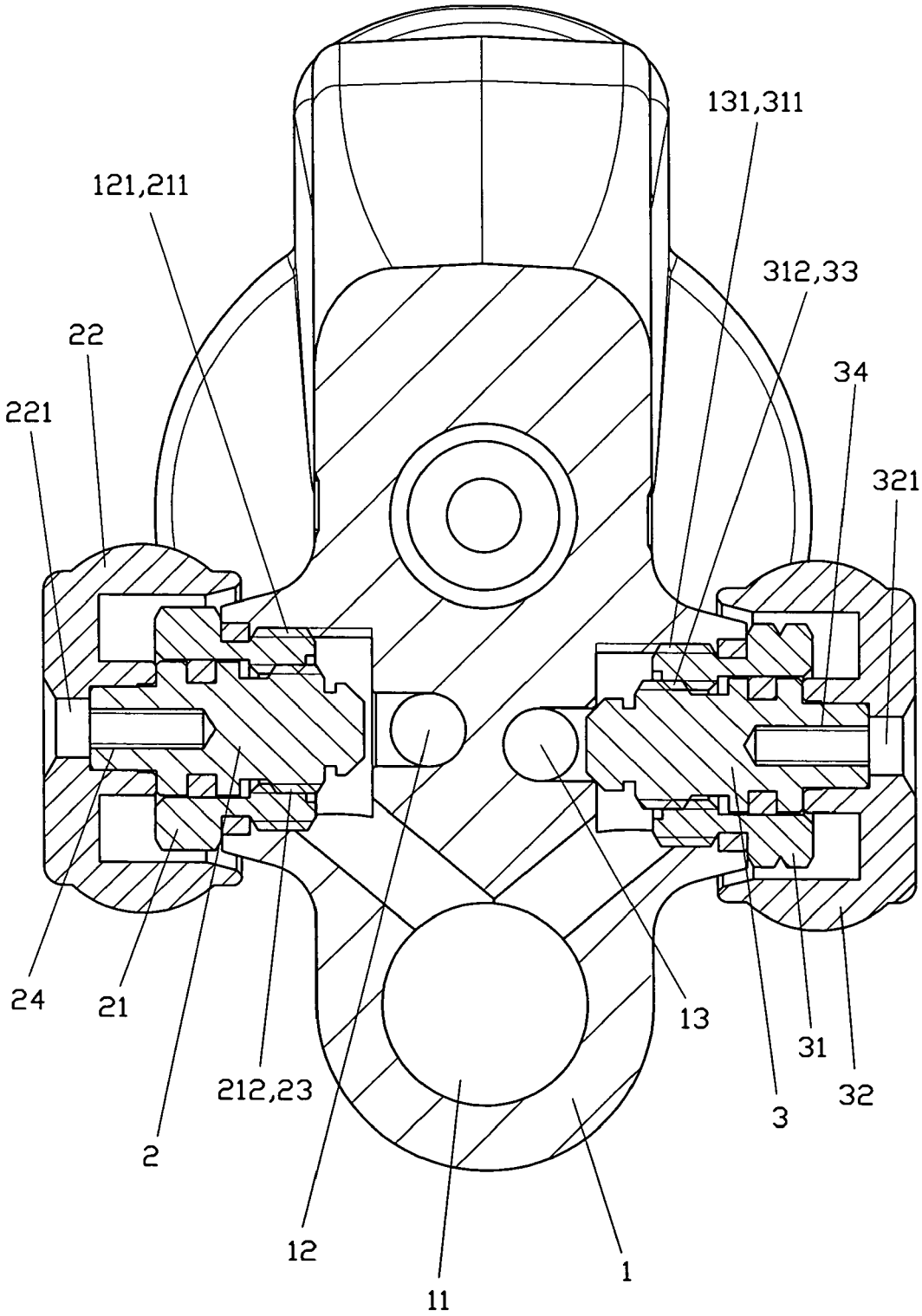
FIG. 2 is a sectional view of the preferred embodiment of the present invention taken from A—A in FIG. 1.

Referring to FIGS. 1 and 2, a preferred embodiment of the present invention comprises a housing (1), a fluid control valve (2), and an atomization control valve (3).

The housing (1) is provided with a pressurized air passage (11). A fluid control air passage (12) and an atomization control air passage (13) are respectively provided in the housing (1). The pressurized air passage (11) is respectively connected to the fluid control air passage (12) and the atomization control air passage (13). Both the fluid control air passage (12) and the atomization control air passage (13) respectively connect through laterally provided threaded holes (121, 131). The fluid control valve (2) further includes a locking nut (21) and a knob (22). The locking nut (21) is hollow and provided with external and internal threads (211, 212) while being fastened with its external thread (211) to the threaded hole (121) connecting through the fluid control air passage (12).

The fluid control valve (2) is relatively engaged to the internal thread (212) of the locking nut (21) by means of a thread (23). Another threaded hole (24) is provided at the end of the fluid control valve (2), and the knob (22) is relatively fastened to the threaded hole (24) by means of a bolt (221).

The atomization control valve (3) also includes a locking nut (31) and a knob (32). The locking nut (31) is hollow and provided with external and internal threads (311, 312) while being fastened with its external thread (311) to the threaded hole (131) connecting through the atomization control air passage (13). The atomization control valve (3) is relatively engaged to the internal thread (312) of the locking nut (31) by means of a thread (33). Another threaded hole (34) is provided at the end of the atomization control valve (3) and the knob (32) is relatively fastened to the threaded hole (34) by means of a bolt (321).

Figure 3:
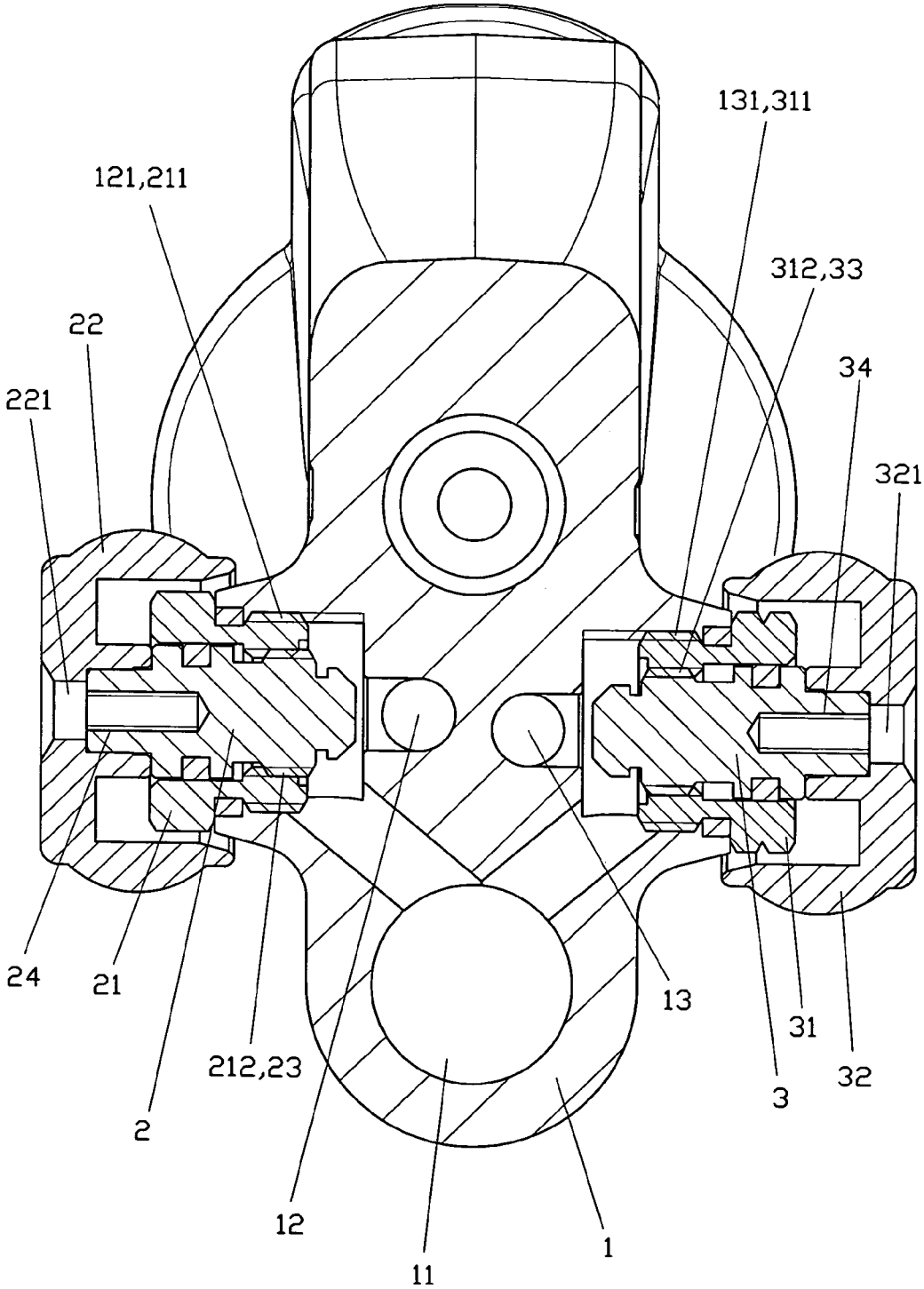
FIG. 3 is a sectional view showing the preferred embodiment of the present invention in an operating status.

In practice as illustrated in FIG. 3, the user simply turns around the knob (22 or 32) in the lateral direction on both sides of the housing (1) to respectively have the fluid control valve (2) or the atomization control valve (3) rotate and move inside the locking nut (21 or 31) so as to respectively adjust the fluid amount to be delivered and the extent of atomization in the fluid control air passage (12) and the atomization control air passage (13).

I claim:

1. A spray paint gun with shunt control comprising a housing containing a built-in pressurized air passage, a fluid control valve and an atomization control valve, and characterized by:

a fluid control air passage and an atomization control air passage being separately provided in the housing; the pressurized air passage respectively connecting with the fluid control air passage and the atomization control air passage; both the fluid control air passage and the atomization control air passage respectively connecting through threaded holes laterally provided; the fluid control valve including a locking nut and a knob, the locking nut being hollow and provided with external and internal threads while being fastened with its external thread to the threaded hole connecting through the fluid control air passage, the fluid control valve being relatively threaded and fastened to the internal thread of the locking nut, and the knob being locked to the fluid control valve; the atomization control valve including a locking nut and a knob, the locking nut being hollow and provided with external and internal threads while being fastened with its external thread to the threaded hole connecting through the atomization control air passage, the atomization control valve being relatively threaded and fastened to the internal thread of the locking nut, and the knob being locked to the atomization control valve.

2. The spray paint gun with shunt control of claim 1, wherein a threaded hole is provided at the end of the fluid control valve and its relative knob is secured in the threaded hole by means of a bolt.

3. The spray paint gun with shunt control of claim 1, wherein a threaded hole is provided at the end of the atomization control valve and its relative knob is secured in the threaded hole by means of a bolt.

* * * * *